US008159148B2

(12) United States Patent
Lee

(10) Patent No.: US 8,159,148 B2
(45) Date of Patent: Apr. 17, 2012

(54) LIGHT EMITTING DIODE LIGHT SOURCE MODULE

(75) Inventor: Wen-Chung Lee, Tainan (TW)

(73) Assignee: Chimei Innolux Corporation (TW)

( * ) Notice: Subject to any disclaimer, the term of this patent is extended or adjusted under 35 U.S.C. 154(b) by 1134 days.

(21) Appl. No.: 11/654,436

(22) Filed: Jan. 16, 2007

(65) Prior Publication Data

US 2007/0164928 A1 Jul. 19, 2007

(30) Foreign Application Priority Data

Jan. 17, 2006 (TW) ..... 95101794 A

(51) Int. Cl.
*H05B 37/02* (2006.01)

(52) U.S. Cl. ..... 315/299; 315/291; 345/102

(58) Field of Classification Search ..... 315/160, 315/161, 185 R, 247, 250, 291, 299, 307, 315/312, 324; 345/102
See application file for complete search history.

(56) References Cited

U.S. PATENT DOCUMENTS

| | | | | |
|---|---|---|---|---|
| 6,510,995 | B2 * | 1/2003 | Muthu et al. | 235/454 |
| 6,888,529 | B2 * | 5/2005 | Bruning et al. | 345/102 |
| 7,202,608 | B2 * | 4/2007 | Robinson et al. | 315/224 |
| 7,265,681 | B2 * | 9/2007 | Chen | 340/815.45 |
| 7,332,897 | B2 * | 2/2008 | Lee et al. | 323/222 |
| 7,999,484 | B2 * | 8/2011 | Jurngwirth et al. | 315/247 |
| 2004/0135522 | A1 * | 7/2004 | Berman et al. | 315/291 |
| 2006/0038803 | A1 * | 2/2006 | Miller et al. | 345/204 |
| 2006/0274024 | A1 * | 12/2006 | Wey et al. | 345/102 |
| 2007/0159421 | A1 * | 7/2007 | Peker et al. | 345/82 |

FOREIGN PATENT DOCUMENTS

JP 6208335 7/1994

* cited by examiner

*Primary Examiner* — Thuy Vinh Tran
(74) *Attorney, Agent, or Firm* — Trop Pruner & Hu, P.C.

(57) ABSTRACT

A light emitting diode (LED) light source module includes plural voltage converters to convert an input voltage into plural corresponding different operation voltages. A plurality of sets of different color LEDs are provided in the light source module, where each set receives a corresponding one of the operation voltages.

20 Claims, 8 Drawing Sheets

LIGHT EMITTING DIODE LIGHT SOURCE MODULE

CROSS-REFERENCE TO RELATED APPLICATION

This claims priority under 35 U.S.C. §119 of Taiwan patent application No. 95101794, filed Jan. 17, 2006, which is hereby incorporated by reference.

TECHNICAL FIELD

The invention relates in general to a light emitting diode (LED) light source module having plural DC voltage converters for corresponding sets of LEDs.

BACKGROUND

FIG. 1 is a block diagram showing a conventional backlight module 10, which includes an AC/DC converter 11, DC-DC voltage converters 121D-12*n*D, 131D-13*n*D and 141D-14*n*D, red light LED (light emitting diode) strings 121-12*n*, green light LED strings 131-13*n*, and blue light LED strings 141-14*n*. The AC/DC converter 11 transforms an AC voltage into a DC voltage. The DC-DC voltage converters 121D-12*n*D, 131D-13*n*D, and 141D-14*n*D, respectively, receive the DC voltage output from the AC/DC converter 11 and transform the DC voltage into operation voltages. The operation voltages from the DC-DC voltage converters are then output to the corresponding LED strings 121-12*n*, 131-13*n*, and 141-14*n* so as to achieve a desired luminance.

In the backlight module 10, each LED string has to be driven by a corresponding DC-DC voltage converter. Generally, the number of LED strings is increased as the panel size is enlarged, and as a result, the number of the DC-DC voltage converters is increased. Consequently, the size of the backlight module 10 is increased, which increases the manufacturing cost of the backlight module.

FIG. 2 is a block diagram showing another example of a conventional backlight module 20. Referring to FIG. 2, the backlight module 20 includes an AC/DC converter 21, a DC-DC voltage converter 22, red light LED strings 231-23*n*, green light LED strings 241-24*n*, blue light LED strings 251-25*n* and constant current controllers 231C-23*n*C, 241C-24*n*C and 251C-25*n*C. The AC/DC converter 21 transforms an AC voltage into a DC voltage, and the DC voltage converter 22 transforms the DC voltage into an operation voltage. During operation, the LED strings 231-23*n*, 241-24*n* and 251-25*n* receive the operation voltage from the DC-DC voltage converter 22, and are respectively coupled to the corresponding constant current controllers 231C-23*n*C, 241C-24*n*C and 251C-25*n*C.

Unlike the backlight module of FIG. 1, the backlight module 20 of FIG. 2 includes just one DC-DC voltage converter 22, which has to drive a relatively large number of the LED strings 231-23*n*, 241-24*n* and 251-25*n*. As a result, the DC-DC voltage converter 22 has to have a relatively large driving capacity, which means that the DC-DC voltage converter 22 is relatively large in size. As a result, the single DC-DC voltage converter 22 consumes a higher amount of power.

Furthermore, in the FIG. 2 implementation, despite the fact that the forward voltages of the red light LED strings 231-23*n*, the green light LED strings 241-24*n* and the blue light LED strings 251-25*n* are different from one another, the same operation voltage is outputted from the single DC-DC voltage converter 22 to drive each of the red light LED strings, the green light LED strings and the blue light LED strings. The forward voltage of an LED is the voltage from the anode to the cathode of the LED at which the LED turns on and starts conducting electricity.

In the arrangement of FIG. 2, when the LED strings turn on, the crossover voltages of the constant current controllers are different from one another. The crossover voltage of a constant current controller is the voltage across the two sides of the constant current controller. The constant current controllers coupled to the LED strings having the lower forward voltages have to withstand a higher crossover voltage, and as a result, the amount of power consumption is higher. In addition, the heat dissipated by the constant current controllers is also increased. Typically, an externally added heat dissipating module has to be provided to lower the temperature, which leads to increased cost.

DETAILED DESCRIPTION

A light emitting diode (LED) light source module according to some embodiments uses a simplified structure of a voltage converter subsystem such that the voltage converter subsystem provides voltages in correspondence with different colors of LEDs (light emitting diodes). Consequently, a crossover voltage of the constant current controller coupled to the LEDs may be minimized or reduced so that the power loss can be reduced, and the efficiency of the constant current controllers can be increased.

In general, according to some embodiments, the voltage converter subsystem includes plural DC-DC voltage converters, or alternatively, plural AC-DC converters, to provide different operation voltages to different sets of color LEDs (e.g., a set of red LEDs, a set of green LEDs, and a set of blue LEDs).

Figure 3:
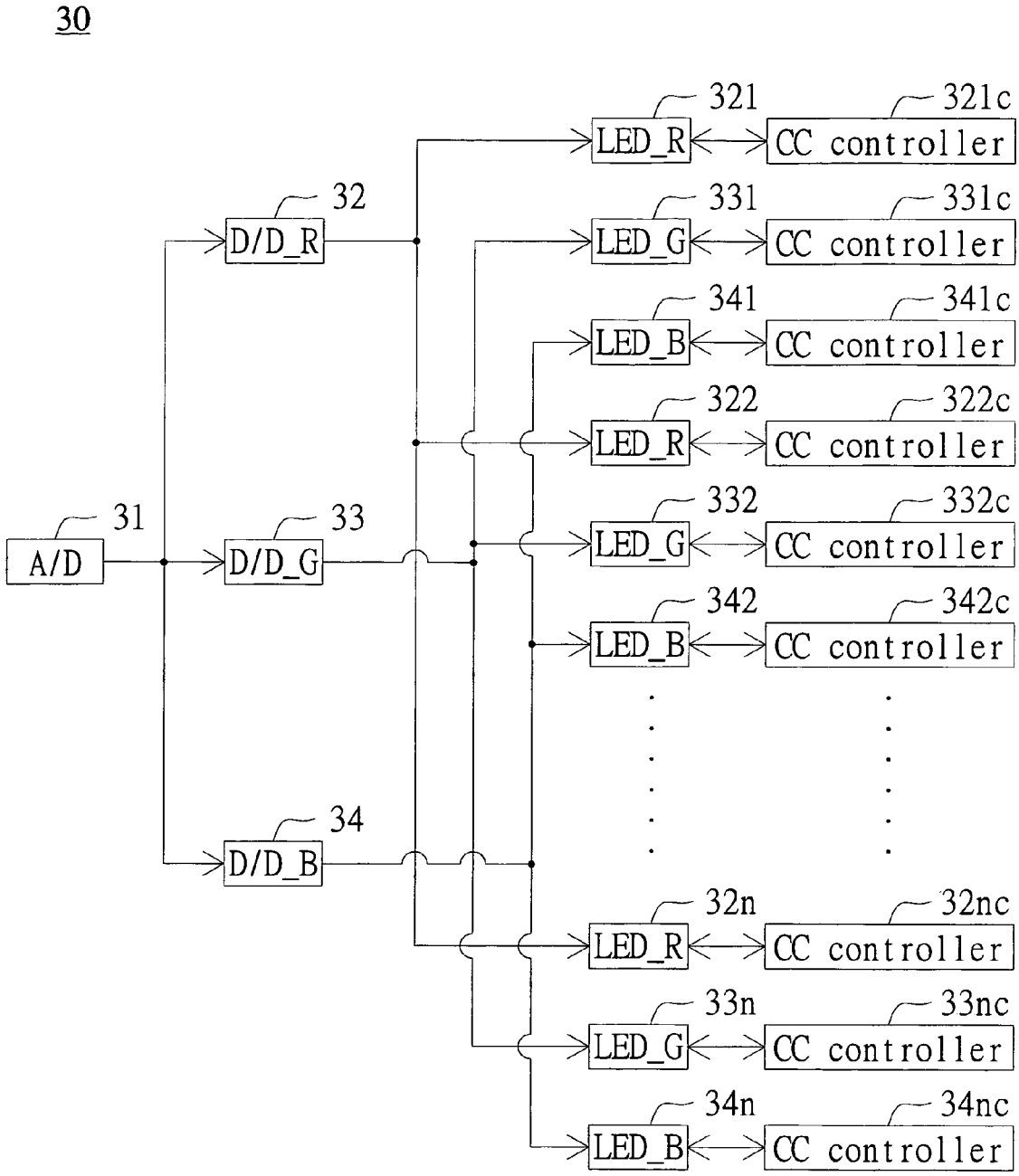
FIG. 3 is a block diagram of a backlight module according to a first embodiment of the invention.

In the ensuing discussion, reference is made to an example backlight module 30 that produces light having three colors. FIG. 3 is a block diagram showing the backlight module 30 according to a first embodiment of the invention. The backlight module 30 includes an AC/DC converter 31, a red light DC-DC voltage converter 32, a green light DC-DC voltage converter 33, a blue light DC-DC voltage converter 34, red light LEDs 321-32*n*, green light LEDs 331-33*n*, blue light LEDs 341-34*n* and corresponding constant current controllers 321C-32*n*C, 331C-33*n*C and 341C-34*n*C.

Note that each LED block (321-32*n*, 331-33*n*, 341-34*n*) can actually refer to a string of LEDs tied in series. In the ensuing discussion, reference to an "LED" can either be to a single LED or a string of LEDs.

The AC/DC converter 31 (which can include a power factor corrector or PFC, for example) receives an AC voltage and transforms the AC voltage into a DC voltage. The red light DC-DC voltage converter 32, which may include a constant current function, as an example, transforms the DC voltage output from the AC/DC converter 31 into a red light operation voltage. The red light operation voltage is output to the red light LEDs 321-32*n*. The red light operation voltage in some embodiments is substantially equal to a forward voltage of a red light LED, when the red light LED turns on. In the context of an LED string having multiple LEDs in series, the red light operation voltage is substantially equal to the summed forward voltages of the red light LEDs that are tied in series.

The green light DC-DC voltage converter 33, which may include a constant current function, as an example, transforms the DC voltage into a green light operation voltage and outputs the green light operation voltage to the green light LEDs 331-33*n*. The green light operation voltage in some embodiments is substantially equal to the forward voltage of a green light LED (or a series of green light LEDs) when the green light LED(s) turn(s) on. The blue light DC-DC voltage converter 34, which may include a constant current function, as an example, transforms the DC voltage into a blue light operation voltage and outputs the blue light operation voltage to the blue light LEDs 341-34*n*. The blue light operation voltage in some embodiments is substantially equal to the forward voltage of a blue light LED (or a series of blue light LEDs) when the blue light LED(s) turn(s) on.

It is noted that the forward voltages of the LEDs of different colors are different from one another. Thus, different operation voltages are supplied to the LEDs of different colors such that the crossover voltages of the constant current controllers and thus power consumption can be minimized or reduced.

The constant current controllers 321C-32*n*C, 331C-33*n*C and 341C-34*n*C, which are respectively coupled to the LEDs 321-32*n*, 331-33*n* and 341-34*n*, control currents passing through the corresponding LEDs to achieve a target or predetermined luminance. The constant current controller 321C-32*n*C, 331C-33*n*C and 341C-34*n*C may be implemented using a digital controller or a simple linear constant current circuit or a high-frequency switching constant current circuit. A constant current controller controls current passing through an LED such that a constant current passes through the LED regardless of input voltage.

Figure 4:
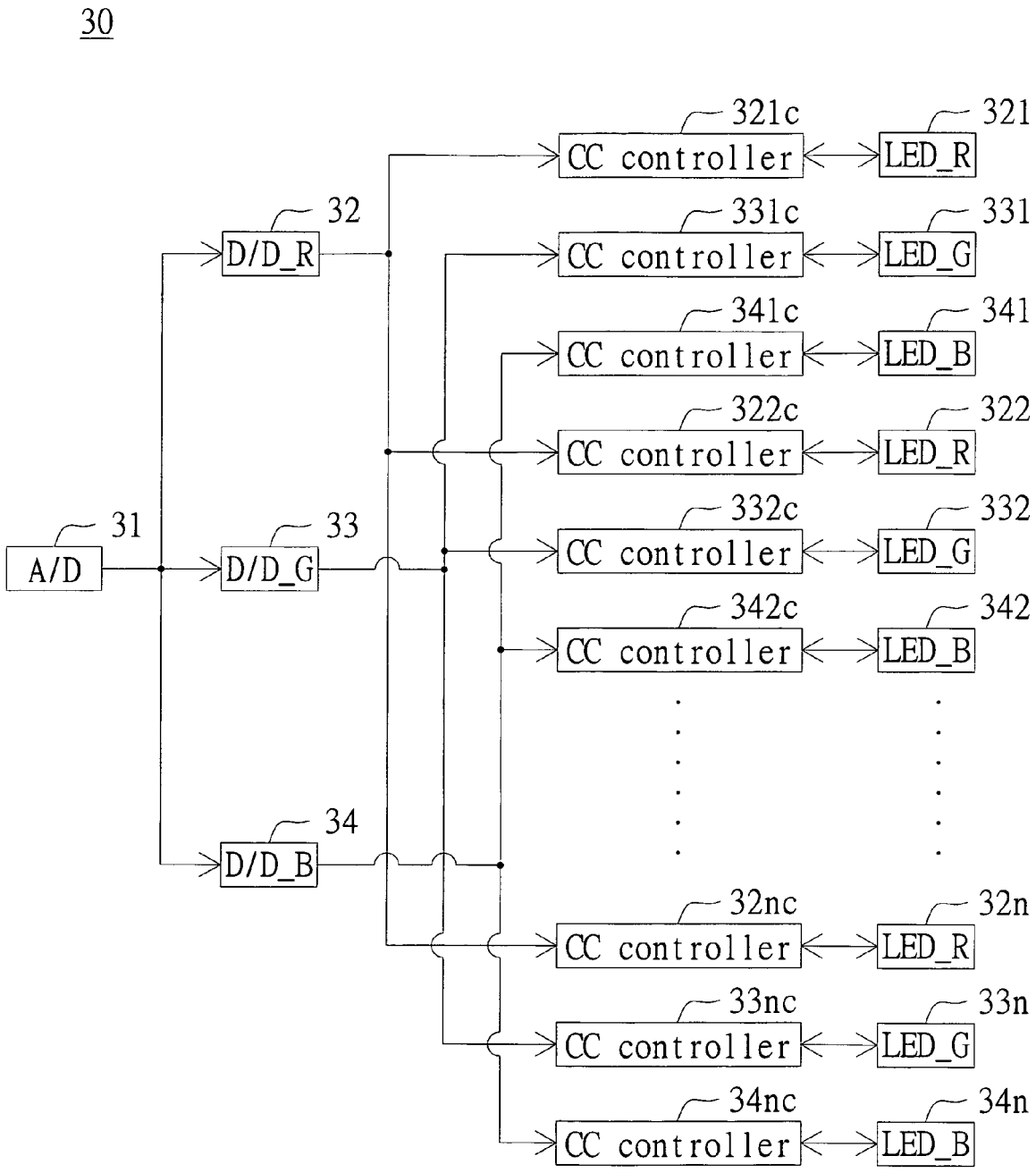
FIG. 4 is a block diagram of a backlight module according to a second embodiment of the invention.

The constant current controllers 321C-32*n*C, 331C-33*n*C and 341C-34*n*C in the backlight module 30 may also be disposed at different positions with respect to the LEDs. FIG. 4 is a block diagram showing a backlight module according to a second embodiment of the invention. As shown in FIG. 4, the constant current controllers 321C-32*n*C, 331C-33*n*C and 341C-34*n*C are respectively coupled to the outputs of the red light DC-DC voltage converter 32, the green light DC-DC voltage converter 33 and the blue light DC-DC voltage converter 34. The LEDs 321-32*n*, 331-33*n* and 341-34*n* are coupled to the corresponding constant current controllers 321C-32*n*C, 331C-33*n*C and 341C-34*n*C.

Figure 5:
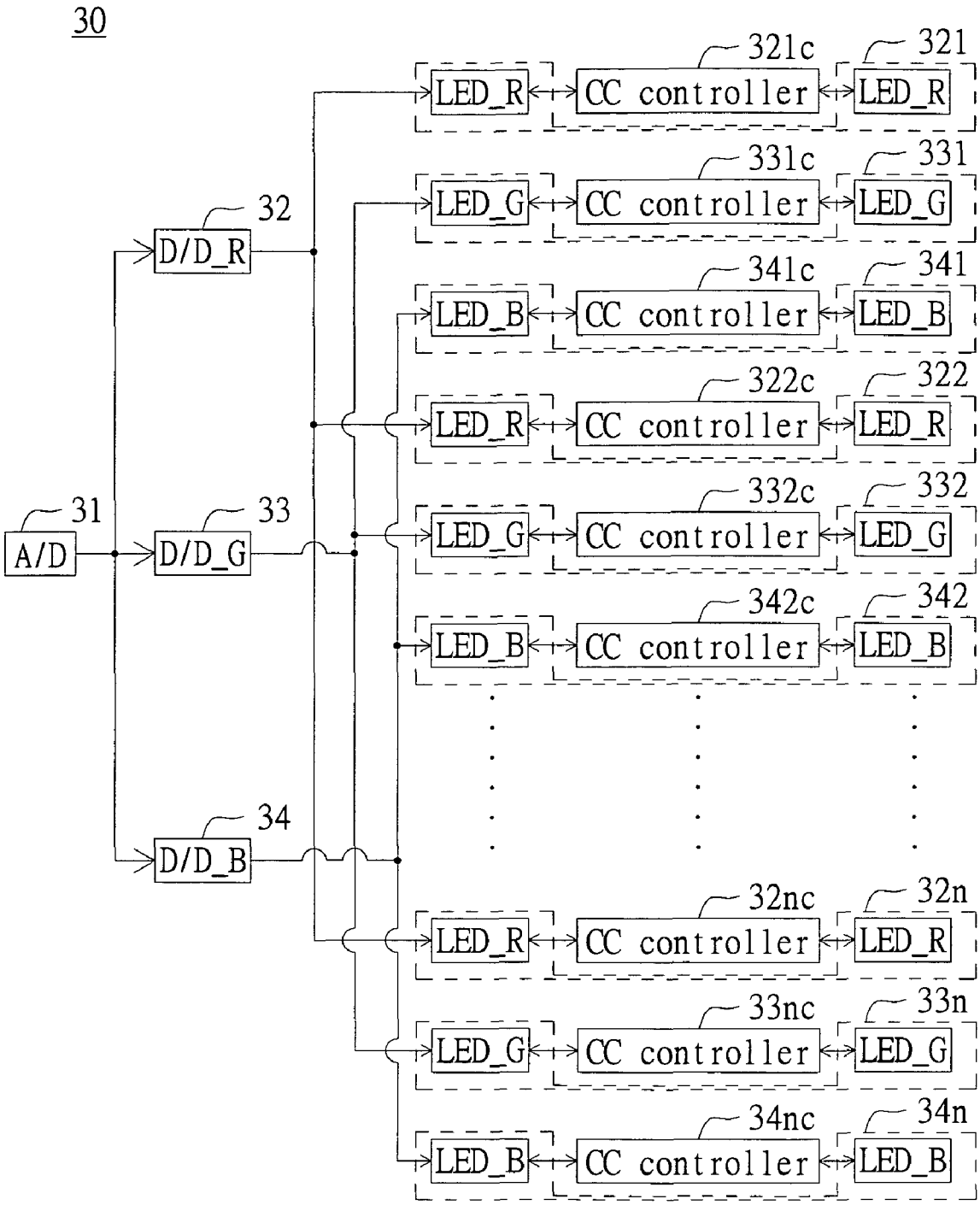
FIG. 5 is a block diagram of a backlight module according to a third embodiment of the invention.

FIG. 5 is a block diagram showing a backlight module according to yet another embodiment of the invention. As shown in FIG. 5, the constant current controllers 321C-32*n*C, 331C-33*n*C and 341C-34*n*C may be disposed within respective strings of LEDs. For example, as depicted in FIG. 5, a constant current controller 321*c* is connected in series with LEDs that are part of string 321. The same arrangement is repeated for other constant current controllers in other LED strings.

Figure 6:
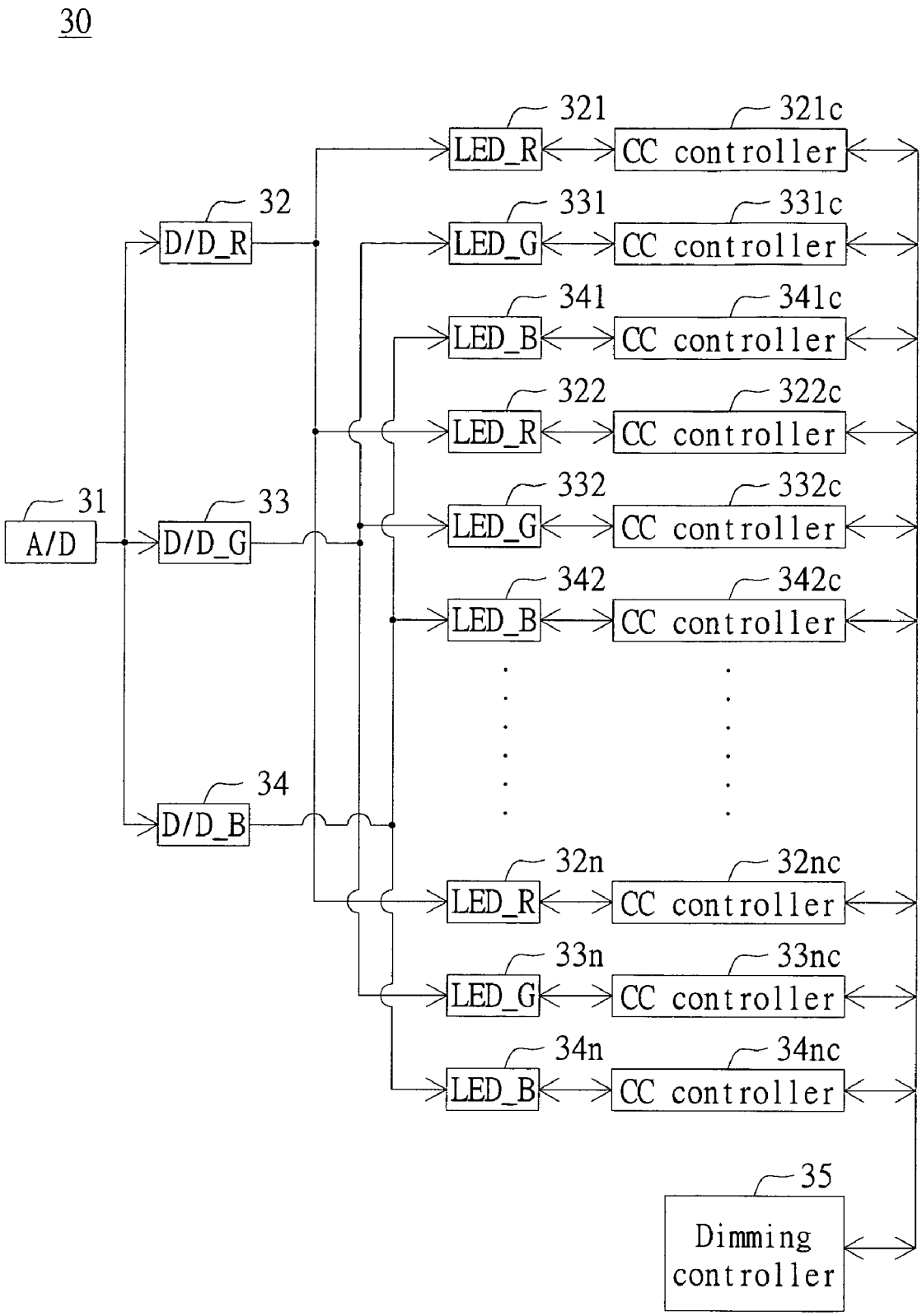
FIG. 6 is a block diagram of a backlight module according to a fourth embodiment of the invention.

Alternatively, as depicted in FIG. 6, the backlight module 30 may also include an additional dimming controller (or luminance regulator) 35 for regulating the luminance of the LEDs. As shown in FIG. 6, the dimming controller 35 in the backlight module 30 is coupled to the constant current controllers 321C-32*n*C, 331C-33*n*C and 341C-34*n*C to control the currents of the constant current controllers 321C-32*n*C, 331C-33*n*C and 341C-34*n*C and to regulate the luminance of the corresponding color LEDs. The dimming controller 35 controls the driving current of the constant current controllers using a pulse-width modulation (PWM) technique.

Figure 7:
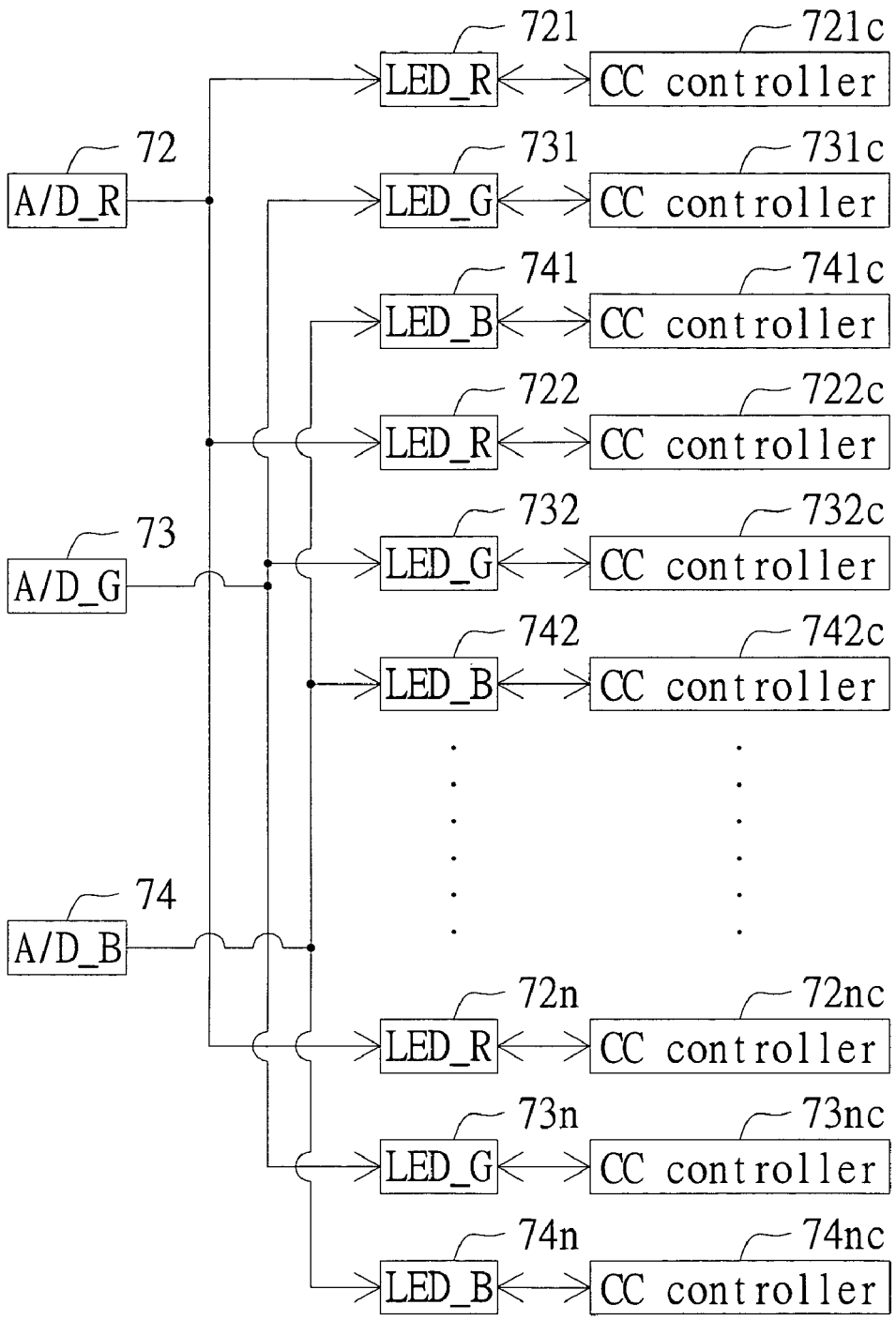
FIG. 7 is a block diagram of a backlight module according to a fifth embodiment of the invention.

In another embodiment, as depicted in FIG. 7, the AC/DC converter 31, the red light DC-DC voltage converter 32, the green light DC-DC voltage converter 33 and the blue light DC-DC voltage converter 34 in the backlight module 30 may be integrated to simplify the circuit. Referring to FIG. 7, the red light AC/DC converter 72 in the backlight module 70, which may include a constant current function or a power factor corrector (PFC), for example, transforms the AC voltage into the red light operation voltage and outputs the red light operation voltage to the red light LEDs 721-72*n*. The red light operation voltage is substantially equal to the forward voltage of the red light LED string when the LEDs in the string turn on.

The green light AC/DC converter 73, which may include a constant current function or include a power factor corrector (PFC), transforms the AC voltage into the green light operation voltage and outputs the green light operation voltage to the green light LEDs 731-73*n*. The green light operation voltage is substantially equal to the forward bias of the green light LED string. The blue light power transformer 74, which may include a constant current function or include a power factor corrector (PFC), transforms the AC voltage into the blue light operation voltage and outputs the blue light operation voltage to the blue light LEDs 741-74*n*. The blue light operation voltage is substantially equal to the forward voltage of the blue light LED string. The constant current controllers 721C-72*n*C, 731C-73*n*C and 741C-74*n*C are respectively coupled to the LEDs to control the currents passing through the corresponding LEDs to achieve a target or predetermined luminance.

Figure 8:
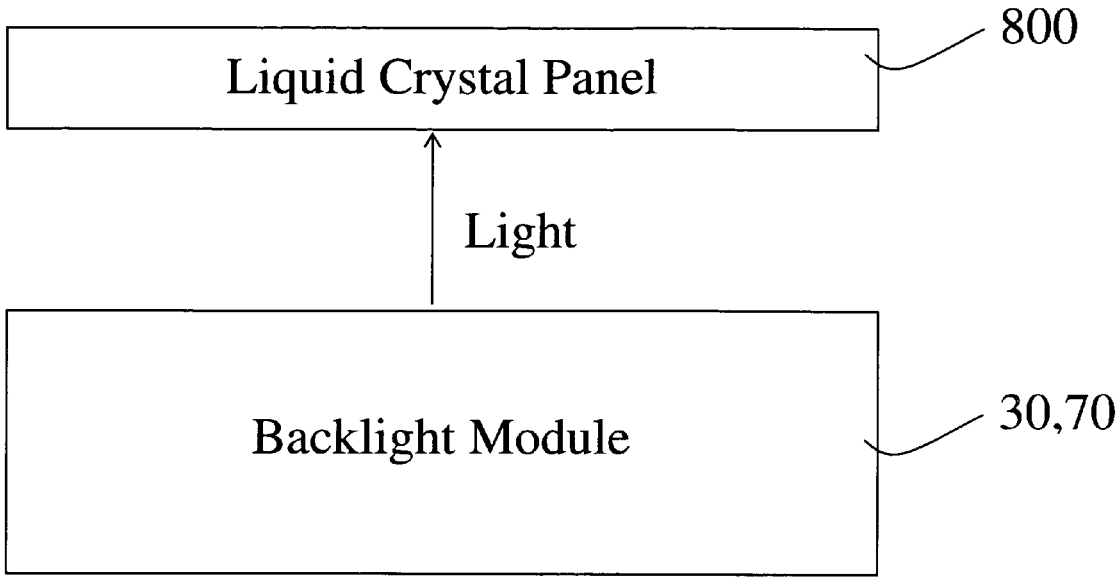
FIG. 8 illustrates an exemplary liquid crystal display device that includes a backlight module according to an embodiment.

FIG. 8 illustrates an example liquid crystal display (LCD) device in which a backlight module 30, 70 according to an embodiment can be used. The LCD device includes a liquid crystal panel 800 positioned proximate the backlight module 30, 70 to receive light from the backlight module 30, 70 during operation.

Figure 1:
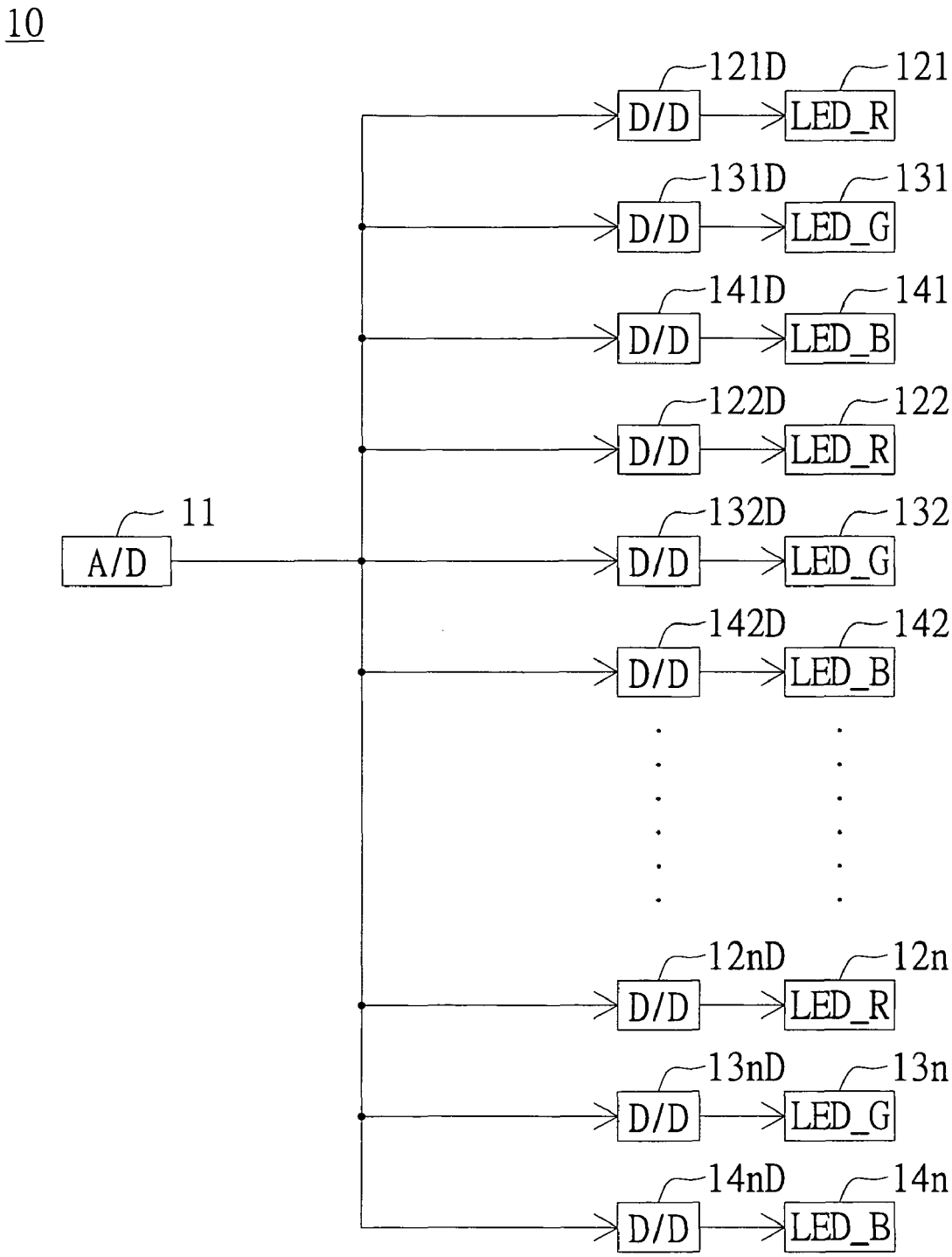
FIG. 1(PRIOR ART)
FIG. 1 is a block diagram of a conventional backlight module.
Figure 2:
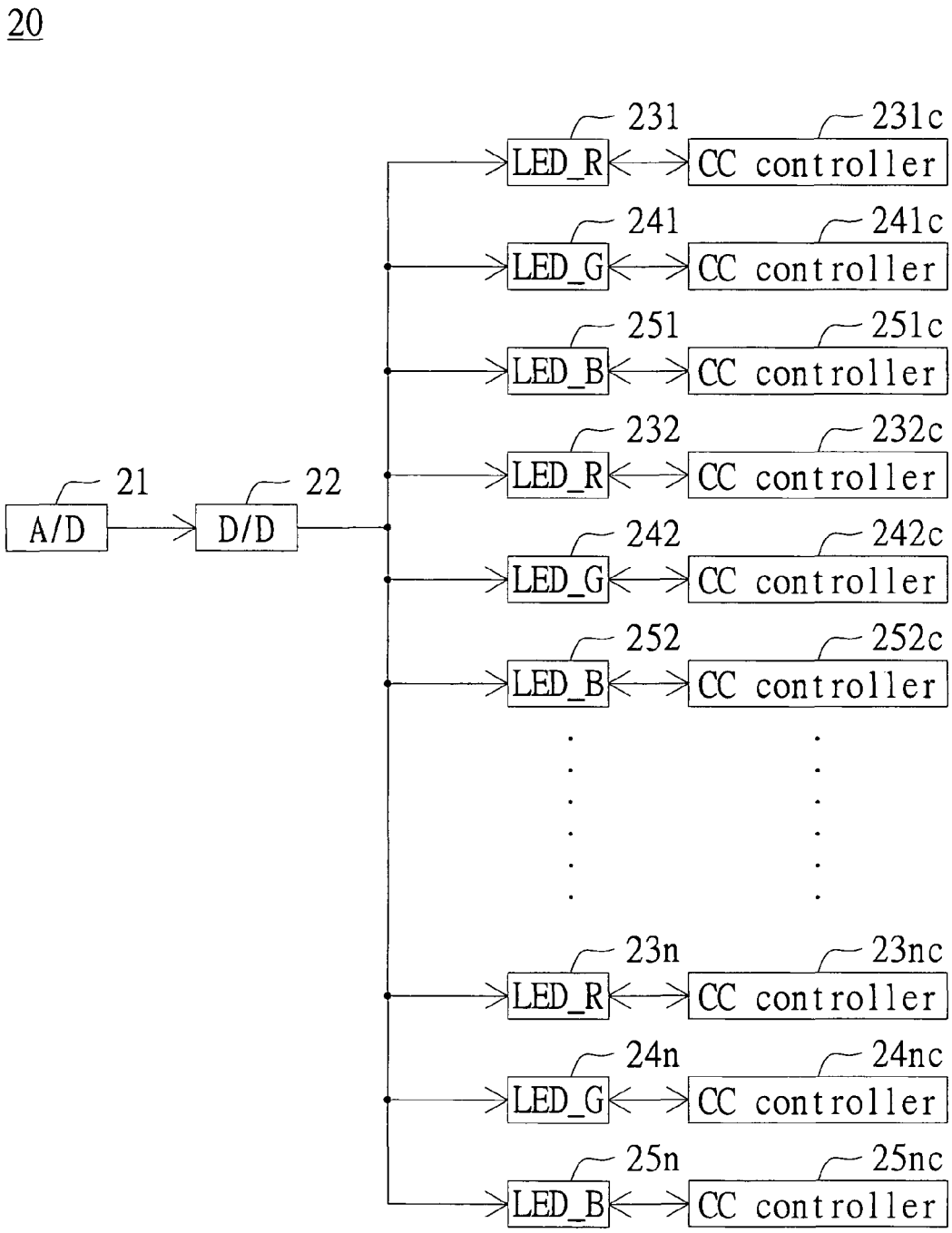
FIG. 2(PRIOR ART)
FIG. 2 is a block diagram of another conventional backlight module.

In the backlight modules and the driving devices thereof according to the embodiments of the invention, a simplified structure of a voltage converter subsystem is used so that different operation voltages in correspondence with the LEDs with different colors are provided. Consequently, the crossover voltages of constant current controllers used to control respective LEDs may be minimized or reduced, such that power loss can be reduced and efficiency can be enhanced. In addition, compared with the conventional backlight module of FIG. 1, the number of DC-DC voltage converters used in some embodiments of the invention is reduced, so the required manufacturing cost can be accordingly reduced. Compared with the conventional backlight module of FIG. 2, some embodiments of the invention utilize three DC-DC voltage converters (instead of just one DC-DC voltage converter) in correspondence with three colors, to reduce the amount of power that has to be driven by each DC-DC voltage converter.

While the invention has been disclosed with respect to a limited number of embodiments, those skilled in the art will appreciate numerous modifications and variations therefrom.

It is intended that the appended claims cover such modifications and variations as fall within the true spirit and scope of the invention.

What is claimed is:

1. A light emitting diode (LED) light source module, comprising:

plural voltage converters to convert an input voltage into plural corresponding different operation voltages;

a plurality of sets of different color LED strings, wherein each set of the plurality of sets has plural LED strings of a corresponding color, the plurality of sets to receive the corresponding different operation voltages;

a plurality of constant current controllers, respectively serially connected to the corresponding LED strings, for respectively controlling currents passing through the corresponding LED strings to achieve a target luminance; and a dimming controller, coupled to the constant current controllers, the dimming controller to control currents of the constant current controllers to regulate luminance of the corresponding color LED strings.

2. The module of claim 1, wherein each of the constant current controllers is coupled between the corresponding voltage converter and the corresponding LED string.

3. The module of claim 1, wherein each of the constant current controllers is disposed in a corresponding LED string between LEDs of the corresponding LED string.

4. The module of claim 1, further comprising an AC/DC converter for transforming an AC voltage into the input voltage, wherein the input voltage comprises a DC voltage.

5. The module of claim 4, wherein the AC/DC converter comprises a power factor corrector (PFC).

6. The module of claim 1, wherein the voltage converters comprise constant current functions.

7. The module of claim 1, wherein the plural voltage converters comprise a first color voltage converter to transform an AC voltage into a first color operation voltage, wherein the input voltage comprises the AC voltage, and wherein the plural voltage converts further comprise a second color voltage converter to transform the AC voltage into a second, different color operation voltage.

8. The module of claim 1, wherein the plural voltage converters comprise DC-DC voltage converters.

9. The module of claim 1, wherein the plurality of sets include first, second, and third sets, wherein the first set of LED strings is to receive a first of the operation voltages, the second set of LED strings is to receive a second of the operation voltages, and the third set of LED strings is to receive a third of the operation voltages.

10. The module of claim 1, wherein each of the LED strings includes plural LEDs connected in series.

11. A liquid crystal display, comprising:

a panel; and a backlight module positioned proximate the panel, comprising:

plural voltage converters to convert an input voltage into plural corresponding different operation voltages;

a plurality of sets of different color LED strings, wherein each set of the plurality of sets has plural LED strings of a corresponding color, and each set of the plurality of sets is to receive a corresponding different one of the operation voltages;

a plurality of constant current controllers, respectively serially connected to the corresponding LED strings, for respectively controlling currents passing through the corresponding LED strings to achieve a target luminance; and a dimming controller, coupled to the constant current controllers, the dimming controller to control currents of the constant current controllers to regulate luminance of the corresponding color LED strings.

12. The liquid crystal display of claim 11, wherein the backlight module further comprises an AC/DC converter to convert an AC voltage into a DC voltage, wherein the input voltage comprises the DC voltage.

13. The liquid crystal display of claim 12, wherein the AC/DC converter comprises a power factor corrector (PFC).

14. The liquid crystal display of claim 11, wherein the voltage converters comprise constant current functions.

15. The liquid crystal display of claim 11, wherein the sets of different color LED strings comprise a first set of first color LED strings and a second set of second color LED strings, and wherein the plural voltage converters comprise a first DC-DC voltage converter to produce a first one of the operating voltages that is received by the first set of LED strings, and a second DC-DC voltage converter to produce a second one of the operating voltages that is received by the second set of LED strings.

16. The liquid crystal display of claim 11, wherein each of the LED strings includes plural LEDs connected in series.

17. A method for use in a backlight module, comprising:

receiving, by plural voltage converters in the backlight module, an input voltage;

transforming, by the plural voltage converters, the input voltage into plural corresponding different operating voltages;

providing the plural different operation voltages to plural corresponding sets of different color light emitting diode (LED) strings, wherein each set of the plural sets has plural LED strings of a corresponding color;

controlling currents passing through the corresponding LED strings to achieve a target luminance by a plurality of constant current controllers, the constant current controllers respectively serially connected to the corresponding LED strings; and control currents of the constant current controllers to regulate luminance of the corresponding color LED strings by a dimming controller coupled to the constant current controllers.

18. The method of claim 17, wherein transforming the input voltage into plural different operation voltages comprises transforming an input DC voltage provided by an AC/DC converter.

19. The method of claim 17, wherein transforming the input voltage into plural different operation voltages comprises transforming an input AC voltage into the plural different operation voltages.

20. The method of claim 17, wherein each of the LED strings includes plural LEDs connected in series.

* * * * *